US005474832A

United States Patent [19]

Massey

[11] Patent Number: 5,474,832

[45] Date of Patent: Dec. 12, 1995

[54] FILM TYPE PACKING ELEMENT FOR USE IN COOLING TOWERS

[75] Inventor: Thomas H. Massey, Marlborough, United Kingdom

[73] Assignee: National Power PLC, London, United Kingdom

[21] Appl. No.: 193,155

[22] PCT Filed: Aug. 6, 1992

[86] PCT No.: PCT/GB92/01457

§ 371 Date: Feb. 8, 1994

§ 102(e) Date: Feb. 8, 1994

[87] PCT Pub. No.: WO93/03320

PCT Pub. Date: Feb. 18, 1993

[30] Foreign Application Priority Data

Aug. 8, 1991 [GB] United Kingdom ..... 9117124

[51] Int. Cl.[6] ..... B32B 3/28

[52] U.S. Cl. ..... 428/182; 428/167; 428/183; 428/184; 428/192; 261/112.2

[58] Field of Search ..... 428/182, 184, 428/186, 167, 183, 178, 192, 119, 174, 81, 101; 55/257.1; 261/112.2, DIG. 11; 165/166

[56] References Cited

U.S. PATENT DOCUMENTS

| | | | |
|---|---|---|---|
| 3,281,307 | 10/1966 | Moeller et al. | 161/68 |
| 3,415,502 | 12/1968 | Munters | 261/112 |
| 3,540,702 | 11/1970 | Uyama | 261/112 |
| 4,344,899 | 8/1982 | Monjoie | 261/112 |
| 4,518,544 | 5/1985 | Carter et al. | 261/112 |
| 4,657,711 | 4/1987 | Wigley | 261/79.2 |
| 4,668,443 | 5/1987 | Rye | 261/112 |

FOREIGN PATENT DOCUMENTS

| | | |
|---|---|---|
| 0053829AZ | 6/1982 | European Pat. Off. . |
| 962432 | 7/1964 | United Kingdom . |
| 7233375 | 4/1974 | United Kingdom . |
| 2255568 | 7/1975 | United Kingdom . |
| 1491454 | 11/1977 | United Kingdom . |
| 2386008 | 10/1978 | United Kingdom . |

*Primary Examiner*—Donald J. Loney
*Attorney, Agent, or Firm*—Kinney & Lange

[57] ABSTRACT

A film-type packing element (1) for use in a cooling tower comprises a formable sheet material formed with corrugations (3) and ridge formations (5) extending obliquely of the direction of the corrugations (3) to provide deflection channels for fluid descending over the packing element. The ridge formations (5) are divided into a plurality of groups (9) along the corrugation direction, with the ridge formations (5) of successive groups (9) being angled oppositely relative to the corrugation direction.

28 Claims, 4 Drawing Sheets

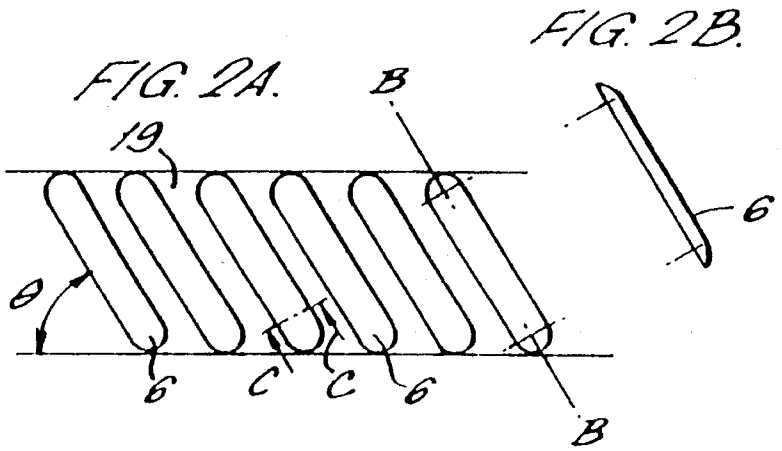
FIG. 2A.
FIG. 2B.
6
B
B
6
C
C
6
19
θ
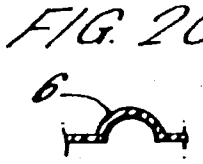
FIG. 2C.
6
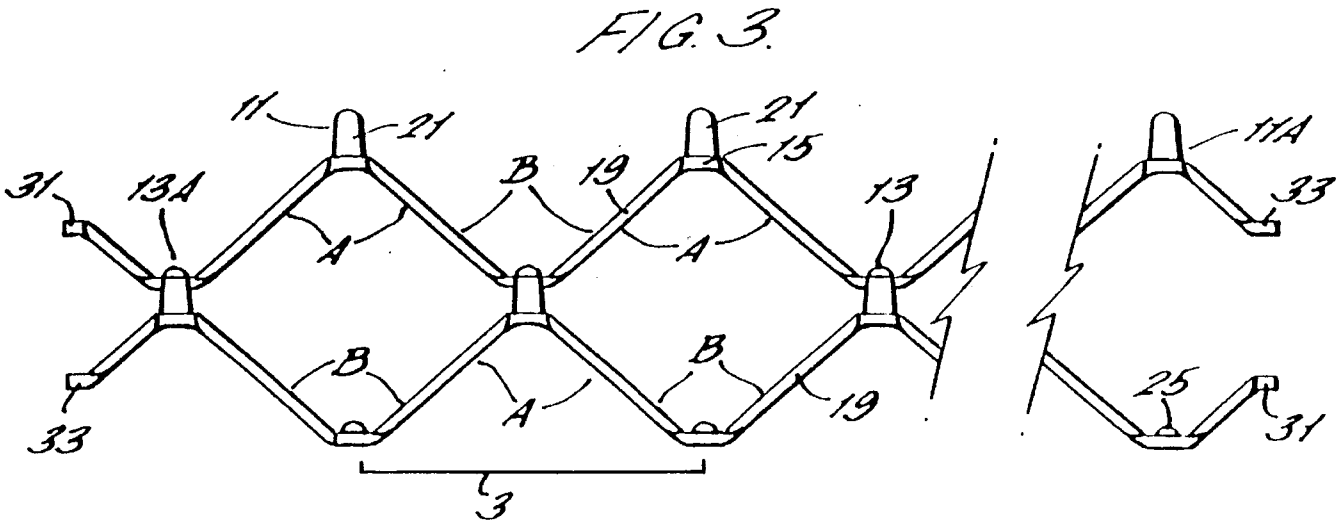
FIG. 3.
11A
33
31
25
13
19
21
15
A
B
19
B
A
3
21
A
B
11
13A
31
33

FILM TYPE PACKING ELEMENT FOR USE IN COOLING TOWERS

BACKGROUND OF THE INVENTION

This invention relates to packing elements for heat exchange and mass transfer between liquid and gas phases of fluid, for use in, for example, cooling towers. In particular this invention relates to regular or ordered packing elements formed from formable sheet material and having corrugations.

A common object in the design of any cooling tower pack is to provide a pack with efficient heat exchange and mass transfer characteristics. In fulfilling this object it is important to maximise the surface area to volume ratio of liquid on the pack and hence to effect an even distribution of fluid over the pack. Uniform wetting is easily achieved in self-wetting woven wire fabric elements where capillary forces act between the fibres. One drawback of such elements is that they are expensive to produce. In contrast, elements made from formable sheet material such as Polyvinylchloride (PVC), Polythene etc. are much cheaper to produce. However, designing a packing element from sheet material which achieves a uniform distribution of liquid over the surface of the sheet and thus efficient mass transfer from bulk liquid to film, is not a trivial matter, especially since capillary forces do not act between the liquid and sheet element as in the fabric elements.

Forming the sheets with folds or corrugations represents the most common method of increasing the surface area. Liquid flowing over the sheets is spread laterally either by inclining the corrugations at an angle to the vertical or by forming the sheets with secondary perturbations, or by incorporating in the sheet a combination of both.

Regular packing elements consisting of corrugated sheets fixed together to form an array of parallel vertical passageways, such as in GB-A-2,093,967 and EP-A-28545, have a number of advantages over other known packing arrangements.

In a conventional cooling tower, liquid is sprayed onto the pack from an array of horizontal plan sprays located above the pack. Packs whose passageways are disposed at an angle to the vertical have shadowed areas at the entrance of the pack which cannot be wetted effectively, and in the case of vertically falling liquid cannot be wetted at all. Thus, an advantage of packs having vertically standing passageways is that every unit area of the entry faces has an equal probability of being wetted.

In packs with slanted corrugations the liquid tends to concentrate into channels defined by the corrugations, resulting in a non uniform distribution of liquid over the pack. Furthermore, liquid flowing over the corrugations is for part of the time suspended from above, increasing the probability of the liquid becoming dissociated from the surface of the sheet. This loss of liquid results in a loss of thermal performance. In contrast, packing elements having corrugations vertically aligned do not suffer from either of these intrinsic problems.

In natural-draft cooling towers operating in counter-flow mode the air flow is governed by the relation between the buoyancy forces and the pack impedance. A pack with vertical passageways will present less impedance to the air flow than packs which are inclined to the vertical, because the passageways run parallel to the air flow direction. By the same argument, packs with horizontally disposed passageways present less impedance to the air flow in cross-flow cooling towers.

A still lower impedance is achieved for packs in which both the cross-sectional geometry of the corrugations forming the passageways and their cross-sectional area remain constant over the length of the pack. The impedance is further reduced if the passageways formed by the corrugations are linear.

A lower impedance results in a lower pressure drop along the length of the packing element for a given air flow and, therefore, in a natural draught cooling tower, a larger air flow for a given buoyancy induced driving force. This results in a more efficient heat exchange and mass transfer between the liquid and gas phases across the boundary layer for several reasons. Air flowing next to the boundary layer at any given point will be cooler and less saturated than air having a lower velocity, giving a larger thermal gradient across the layer resulting in a correspondingly higher rate of heat exchange. The faster air flow also promotes the diffusion of saturated air away from the boundary layer next to the water film, thus enhancing the evaporation rate, cooling the liquid further.

A further advantage of vertically disposed corrugated sheets is that they have considerable strength in the vertical, i.e. load bearing direction.

Although packs comprising vertical corrugated sheets have certain advantages as mentioned above, there remain a number of practical problems to be overcome, which may be solved with an appropriate design.

As mentioned above, it is common to employ an array of horizontal plan jets to spray the liquid onto the pack. A common problem associated with this water distribution apparatus is that liquid impinging on the top of the pack will have an uneven coverage across the pack. An object of the present invention is to provide a packing element which promotes fast and effective distribution of liquid from the top of the pack over a relatively short vertical distance, and thereafter to maintain an even coverage as the liquid continues to propagate.

The liquid coolant in many cooling tower applications is water drawn from rivers, and is preferred because it is readily available and therefore cheap. This water is usually contaminated with suspended particles of sedimentary deposits as well as other particulate or viscous contaminants. Use of such water in unpurified form exposes the packing elements to the possibility of fouling. Initially the deposits will be trapped at points in the surface structure where the liquid is caused to stagnate. In such regions the particles will tend to be deposited and build up on the surface thus enhancing the stagnation region and increasing the deposition. In time, this will cause essentially two problems. The deposits will form a layer, tending to smooth over any surface structure, so that liquid is deflected to an ever decreasing degree with the result that the patterned surface loses its effectiveness in distributing the liquid. In the worst case the layer would destroy all surface structure, leaving a planar sheet. This would drastically reduce the efficiency of the pack as well as increase its overall weight. Furthermore, the build-up of fouling will begin to restrict the free space between neighbouring sheets, thereby increasing the impedance to the air flow. This causes a reduction in air flow with consequent loss of performance of the pack. Finally, if the fouling is great enough, the weight of it will compromise the structure of the cooling tower.

Another problem in designing a cooling tower pack is to provide an appropriate surface structure which compels the falling liquid to reside on the sheet for an adequate period of time (dwell time), so that the liquid is cooled effectively and sufficiently from the moment the liquid enters the pack to the time it reaches the bottom of the pack. Appropriate surface structure is essential in achieving this, but surface structure tends to promote fouling. Thus, there is a trade-off between optimising the dwell time and reducing the possibility of fouling to a minimal extent.

It is a further object of the present invention to provide a pack in which the dwell time of liquid on the pack can be optimised whilst at the same time the possibility of fouling by deposits can be minimised, thereby prolonging the effectiveness and lifetime of the pack.

The problem to be solved is to provide a cooling tower pack which fulfils all of the above mentioned objects.

SUMMARY OF THE INVENTION

According to a first aspect of the present invention, there is provided a film-type packing element for use in a cooling tower comprising a formable sheet material formed with corrugations and ridge formations extending obliquely of the direction of the corrugations to provide deflection channels for fluid descending over the packing element, the ridge formations being divided into a plurality of groups along the corrugation direction with the ridge formations of the successive groups being angled oppositely relative to said direction.

Thus, by providing ridge formations extending obliquely of the direction of the corrugations wherein the ridge formations are divided into a plurality of groups with the ridge formations of successive groups being angled oppositely relative to said direction, liquid descending the sheet will be given lateral momentum in the plane of the sheet, firstly in one direction and so be entrained across the sheet, and secondly, on reaching the next group of ridge formations will be given lateral momentum in the opposite direction. Thus, the liquid will be entrained in a meander-like path as it propagates along the sheet. In this way, the liquid distribution over the pack is improved.

At the same time, because the ridge formations extend obliquely of the direction of the corrugations, i.e. neither horizontally nor vertically, the possibility of stagnation of liquid descending the sheet, and therefore fouling, is reduced. Furthermore, because the ridge formations are in groups, the liquid is given a series of sideways kicks at each ridge formation. In this way the change of momentum imparted to the liquid is not so severe, so than the particles suspended therein are more able to follow the path of the liquid. This also reduces the possibility of fouling and hence prolongs the performance and life of the packing element.

Simultaneously the dwell time is made sufficient since each time the liquid interacts with a deflection channel it is decelerated in the vertical direction, counteracting the gravitational force on the liquid so that the fluid maintains an almost constant velocity along the sheet. The velocity is governed by such factors as the angle, height and density of the ridge formations, the volume of liquid and any capillary forces acting between the liquid and the ridge formations. The angle and density of the ridge formations can be varied to optimise the dwell time.

In a preferred embodiment, the packing element has an even number of groups of ridge formations over the dimension of the packing element along the corrugation direction. Thus, when a plurality of such elements are installed in a cooling tower in such a manner that they are stacked one above the other, continuity of successive groups being angled oppositely is maintained. Additionally, it is preferred that each group has the same number of ridge formations so that sideways momentum imparted to the falling liquid tends to average out to zero (by symmetry considerations) over the dimension of the packing element along the corrugation direction. This enhances uniformity of the liquid coverage across the sheet and at the same time prevents liquid concentrating at the side edges of the sheet.

Preferably, the ridge formations are formed to provide a zig-tag pattern transverse to the corrugation direction. This is particularly advantageous in crossflow cooling towers where the corrugations extend horizontally, so that fluid flows transversely of the corrugation direction.

Advantageously, the pitch of the zig-zag pattern can be varied independently of the pitch of the corrugations depending on the application. For example, if in a particular application it is necessary to maintain a sideways momentum in only one direction over a considerable width or over a greater vertical length in the case of cross-flow cooling towers, the pitch of the zig-zag may extend over a plurality of corrugations. On the other hand, if good local cross mixing is of primary importance, the pitch of the zig-zag may be made equal to or less than the pitch of the corrugations.

In a preferred embodiment the ridge formations comprise discrete linear protrusions in the sheet material which extend not more than half a pitch of the corrugations. By providing gaps between the ridge formations, liquid having been directed toward the gap will flow faster along the gap between the ridge formations, thereby reducing hold up and hence build up of liquid at this juncture.

Preferably, the corrugations have a generally triangular wave form with peaks and troughs of the wave form clipped, so as to form flat portions extending along the corrugation direction. Advantageously the flat portions provide gaps between the deflection channels so that liquid is not concentrated in a V-shaped groove which would otherwise be detrimental to the thermal performance of the sheet. This also provides a distance over which the liquid is not being acted upon by the ridge formations so that the liquid transverse velocity decreases due to friction between the sheet surface and the liquid, thereby giving the fluid an equal probability of being accelerated in any of the two lateral directions on reaching the next group.

In a preferred embodiment, groove formations are formed in the sheet perpendicular to the corrugation direction. Advantageously these can be interspaced between successive groups and preferably have a semicircular cross-section so that vertical rigidity is maintained as far as possible, whilst the vertical flow of fluid is not significantly interrupted.

The packing elements preferably include an array of integrally formed stand-offs and complementary sockets extending outwardly therefrom, and situated on the flat portions defining the peaks and troughs of the corrugations to maintain adjacent sheets at spaced relationship. It is desirable to configure the array so that the pack is formed from identical sheets and by turning every other sheet through 180° the stand-offs fall opposite the sockets with all four edges of adjacent sheets aligned perpendicularly of the general plane of each sheet.

Accordingly, a second aspect of the present invention provides a film-type packing element for use in a cooling tower comprising a formable sheet material formed with corrugations and having discrete stand-off formations upstanding along ridge lines of the corrugations on one face of the sheet and discrete socket formations formed along other ridge lines of the corrugations on the other face of said sheet, and positioned so as to engage each other when alternate sheets are rotated substantially 180° in the plane of said sheets.

In a preferred embodiment of this second aspect of the present invention, the stand-off formations and discrete socket formations are spaced at successive ridge lines of the corrugations.

BRIEF DESCRIPTION OF THE DRAWINGS

Examples of embodiments of the present invention will now be described with reference to the drawings, in which:

FIG. 2A shows an expanded elevation view of part of a group of discrete protrusions shown in FIG. 1;

FIG. 2B shows a cross-section through a discrete protrusion along the line B—B;

FIG. 2C shows a cross-section of a protrusion along the line C—C;

FIG. 3 shows a cross-section of two neighbouring packing elements having a generally triangular wave form and spaced apart at discrete points in accordance with a preferred embodiment;

DETAILED DESCRIPTION OF THE PREFERRED EMBODIMENTS

Figure 1:
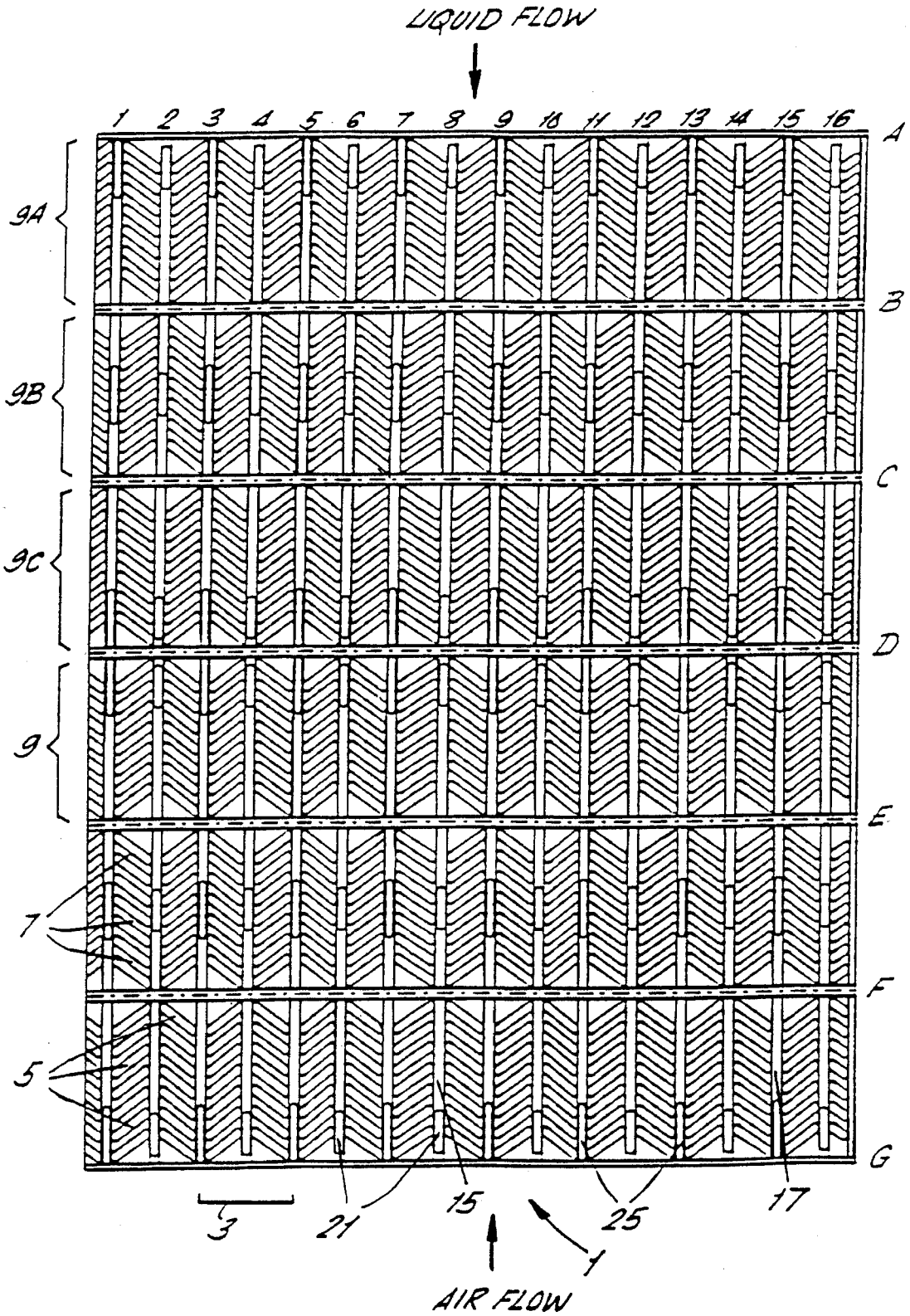
FIG. 1 is an elevation view of a packing element according to a preferred embodiment of the present invention.

Referring to FIGS. 1 to 3, a film-type packing element 1 for use in a counter flow cooling tower comprises a formable sheet material formed with corrugations 3 and ridge formations 5 extending obliquely of the direction of the corrugations to provide deflection channels 7 for fluid descending generally along the corrugations 3. The ridge formations are divided into a plurality of groups 9 along the corrugation direction. Ridge formations of successive groups are angled oppositely relative to the corrugation direction. The dimension of the packing element along the corrugation direction and the width transverse to the corrugation direction are typically 0.6 m and 2.37 m respectively. This embodiment further comprises a number of preferred features which have been carefully refined (after much research) for optimum performance in a cooling tower under normal load conditions, whilst still retaining high performance for conditions deviating significantly from the norm. The preferred directions of liquid and air flow over the packing element in a counterflow cooling tower are shown by arrows in FIG. 1.

Referring to FIG. 3, the corrugations have a generally triangular wave form with the peaks 11 and troughs 13 of the wave form clipped so as to define flat portions 15 and 17, also shown in FIG. 1. The corrugation amplitude and wavelength are typically 19 mm. and 57 mm. respectively, although these dimensions may be varied to change the free space to pack volume ratio. The flats are typically between 6 mm. and 7 mm. wide. The cross-sectional geometry is substantially invariant along the length of the packing element. In use, the sheets are preferably aligned vertically, parallel to the general direction of descending liquid, although some applications may demand the sheets to be either inclined or disposed horizontally, for maximum performance. Such a situation may arise in cross flow cooling towers.

The packing element comprises six groups 9 of ridge formations 5 over the dimension of the packing element along the corrugation direction, with each group 9 having a plurality, for example seven, ridge formations 5. The ridge formations are formed to provide a zig-zag pattern transverse to the corrugation direction and extend over the width of the sheet 1. In this embodiment the pitch of the zig-zag pattern is constant and equal to the pitch of the corrugation. However, the pitch of the zig-zag pattern may vary over the width of the sheet, and may be greater or less than the pitch of the corrugations. At the same time the zig-zag pattern is in phase with the corrugations and although this feature is preferred it is not essential to the invention.

The ridge formations 5 are preferably discrete linear protrusions 6, as shown in FIGS. 1 and 2, each protrusion extending over not more than half the pitch of the corrugations. In the embodiment shown, the protrusions 6 extend between the boundaries defined by the flat portions of neighbouring peaks and troughs of the corrugations. Because the packing element is formed from formable sheet material such as polyvinylchloride (PVC), polythene or metal foil etc., the reverse side will have the negative form of the side shown. Thus, the ridges on one side will define depressions on the other side. In FIG. 1, the protrusions extend upwards from the plane of the figure, defining side 'A' of the sheet. In FIG. 3, side 'A' is inverted, and so faces downwards, with side 'B' facing upwards as shown. Although the ridge formations 5 are discrete linear protrusions, they may also be continuous across the width of the sheet and so have the form of zig-zag secondary corrugations.

FIGS. 2A through 2C show an expanded view of part of a group 9 of discrete protrusions. Each protrusion 6 is elongate and Linear with the ends being semi-circular. The ends of each protrusion are also curved in the direction perpendicular to the sheet as shown in FIG. 2B. The overall length of the protrusion is typically 33 mm. In cross-section, the protrusions are semi-circular with a diameter of typically 6–7 mm. and define similarly shaped depressions on the other side of the sheet as shown in FIG. 2C. The protrusions of each group are parallel to one another and spaced apart to define deflection channels having widths of the same order of magnitude as the widths of each protrusion. The optimum angle, 2 r between each protrusion and the corrugation direction has been found to be substantially 60°.

The rounded nature of the protrusions serves to ease the flow of liquid, reducing the number of sites in which fluid could stagnate or in which deposits may collect. In addition, where the sheets are fabricated by vacuum forming, the rounded profile ensures that weak points delineated by sharp or abrupt edges, are kept to a minimum. Furthermore, the protrusions increase the rigidity and strength of the linear corrugation panels 19 between neighbouring troughs and peaks in directions both parallel and transverse to the corrugation direction. Thus, the overall stiffness and load bearing capability of the packing element is considerably enhanced.

It should be noted that the protrusions are not limited to any particular shape. Indeed, the ridge formations at the ends of each group 9 may have other shapes in order to increase the surface area of the packing element.

To illustrate how the packing element effects liquid distribution over the surface thereof, and to simplify explanation of a complex irrigation process, it is worth considering one particular scenario. Referring to FIG. 1, we first assume that a single unit of liquid starts at the top edge of the sheet at position A9. As the unit of liquid descends it interacts with the protrusions which impart sideways momentum to the liquid in opposite directions. As a result, the unit of liquid separates into two roughly equal portions. At each protrusion the liquid will be given a small sideways kick so that it spreads into a film across the width of the corrugation. On reaching flat portions 15, the liquid is no longer acted upon by the protrusions and so will tend to flow parallel to the corrugation direction. Any liquid which has sufficient momentum to overshoot the flat portions before reaching the bottom of the first group 9A of the ridge formations, will be directed back onto the flats 15. The shape of the surface of the packing element is intended to promote these flow paths whilst presenting as few obstructions to the flow as possible. This assists in reducing hold-up, stagnation and subsequent fouling by deposits which separate from the liquid.

At the second group of ridge formations, liquid an positions B8 and B10 will have an equal probability of being deflected to the left or to the right. Accordingly, after descending the length of the second group 9B the liquid will have spread across a width corresponding to two wavelengths of the corrugations and in this simulation will be distributed with proportions of ¼, ½, ¼ at points C7, C9 and C11 respectively After travelling the length of the third group 9C the liquid will have spread over a width corresponding to three wavelengths of corrugations, after four groups the liquid will have spread over four wavelengths and so on. Thus to generalise, the lateral spread of liquid is increased by one corrugation wavelength after travelling one group length. From this illustration it is possible to appreciate how quick and effective irrigation over the packing element is achieved. Continuing the simulated sequence of irrigation, on reaching the bottom of the sheet the unit of liquid will span six corrugation wave lengths and have concentrations equal to 1/64, 3/32, 15/64, 5/16, 15/64, 3/32 and 1/64 at positions G3, G5, G7 . . . to G15.

This fan-like irrigation process serves several purposes. Firstly, in the situation whereby liquid impinges on a concentrated region at the top of the packing element, the sheet effects a fast lateral spread of fluid across the width of the sheet, whilst at the same time ensuring that the concentration is not depleted at the centre of the spread. This is due to the fact that whilst liquid is being spread in opposite directions across the sheet it is also being directed back into the centre because at each point on a line on the sheet denoted alphanumerically in FIG. 1, fluid has an equal probability of flowing either to the right or to the left. Secondly, it can be appreciated that if the liquid is distributed over the pack at equally spaced points with equal concentrations, a fan-like spread of liquid will result from each point. This ensures that good cross mixing of liquid is achieved whilst at the same time an almost constant concentration of liquid across the sheet at any vertical point is maintained as the liquid continues to propagate. The above illustration is only one of many possible scenarios which may occur in practice. In general the sheet, by a statistical percollation process, will transform a random concentration of liquid starting at the top edge of the sheet, into an even concentration of liquid across the sheet, as the liquid descends.

FIG. 3 shows two identical sheets assembled to provide passageways therebetween, the cross-section of passageways having generally rhombic geometry. The sheets are spaced apart at a predefined distance by discrete stand-offs 21 distributed at intervals along flat portions 15 defining the peaks of the corrugations. The presence of this spacing is important since it allows the free flow of water in the transverse direction.

The stand-offs 21 are integrally formed with the sheet and define depressions on the other side of the sheet. Complimentary sockets 25 are formed an intervals along the flat portions 17 defining the troughs of the corrugations and are positioned such that when every other sheet is rotated 180° in the plane of the sheen the stand-offs and sockets engage. To achieve this with an identical set of sheets, stand-offs 21 are formed on each adjacent peak 11 and sockets 25 are formed between them on each adjacent trough 13. The sheen is formed so that opposed edges 31 and 33, parallel to the corrugation direction, neighbour a trough 13A and a peak 11A respectively. The stand-offs 21 extend typically 8 mm. from the flats 15, and the sockets have a depth such than the spacing between flats of opposed sheets is typically 6 mm.

Figure 4A:
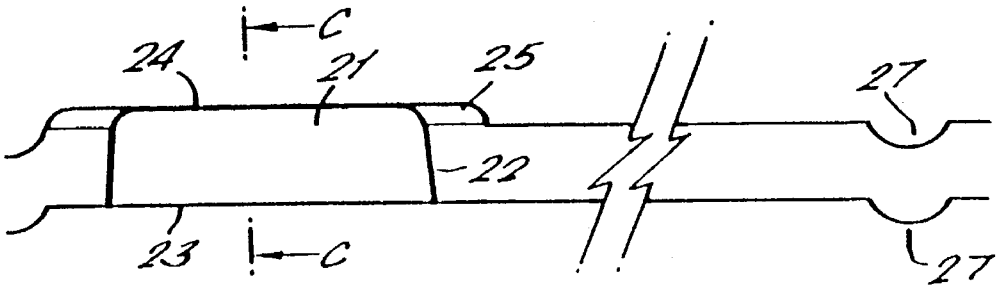
FIG. 4A shows a side view of the stand-off and socket arrangement shown in FIG. 3, and includes a cross-sectional view of the groove formations in accordance with a preferred embodiment.
Figure 4B:
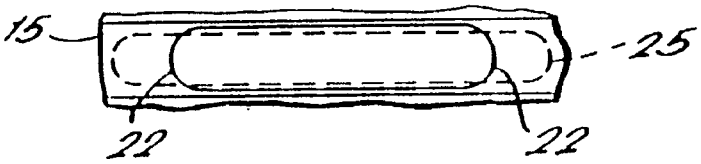
FIG. 4B shows an elevation view of the stand-off and socket arrangement shown in FIG. 4A.
Figure 4C:
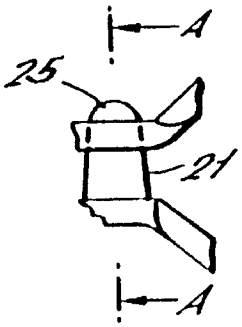
FIG. 4C shows a cross-section through the line C—C in FIG. 4A.

Referring to FIG. 4A through 4C, the stand-offs 21 are elongate with the longer side parallel to the corrugation direction. The end walls 22 are semi-circular in cross-section in accordance with FIG. 4B and also slope inwards so that the base 23 of each stand-off is longer than the top 24. The lengths of the base 23 and top 24 are typically 25 mm. and 20 mm. respectively. This stream lined shape is preferred since it both reduces air flow drag and the possibility of fouling at these points. In addition the inner walls of the stand-offs on the reverse side of the sheet are shaped to ease the flow of liquid to reduce the possibility of liquid stagnating in the cavity. The sockets 25 in which the stand-offs are seated are considerably longer than the top of the stand-offs to assist in alignment during the manufacturing process.

Mating surfaces of the stand-offs and sockets are bonded together by gluing or welding, etc. during pack assembly. In the preferred embodiment shown in FIG. 1, the stand-offs 21 are positioned between each of the groups of ridge formations 9. The purpose of this is to ensure that at some point along each group, water is deflected from the flats 15 and 17 into deflection channels either side, which assists in the liquid distribution process.

Figure 5:
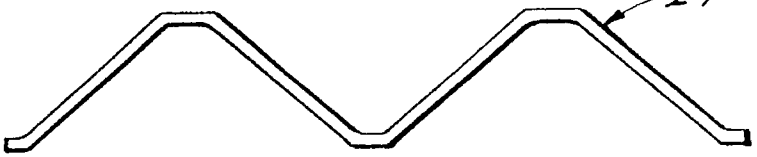
FIG. 5 is a side view of the groove formation shown in FIG. 4A, extending in phase with and transverse to the corrugation direction.

Referring to FIGS. 4A and 5, transverse groove formations 27 running perpendicular to the corrugation direction are formed in the sheet and preferably disposed between each group 9 as shown in FIG. 1. The groove formations enhance the rigidity of the packing element transverse to the corrugation direction. They are preferably semi-circular in profile so that the sheet retains its compressional strength in the direction of the corrugations. On the reverse side of the sheet the groove formations appear as semi-circular humps over which the liquid traverses with minimal effort. The diameter of the groove formations is typically 4 mm.

As will be appreciated, the above described embodiment has the characteristic of minimising the effect of fouling on its performance. Firstly, the rate of build up of fouling is minimized by the avoidance of structures which would cause the water flow to stagnate. Secondly, because the passageways formed by the corrugations are linear, and the surface structure relied upon to effect the liquid distribution does not significantly modify this linearity, any fouling that does occur will impede the air flow to a minimal extent.

Figure 6:
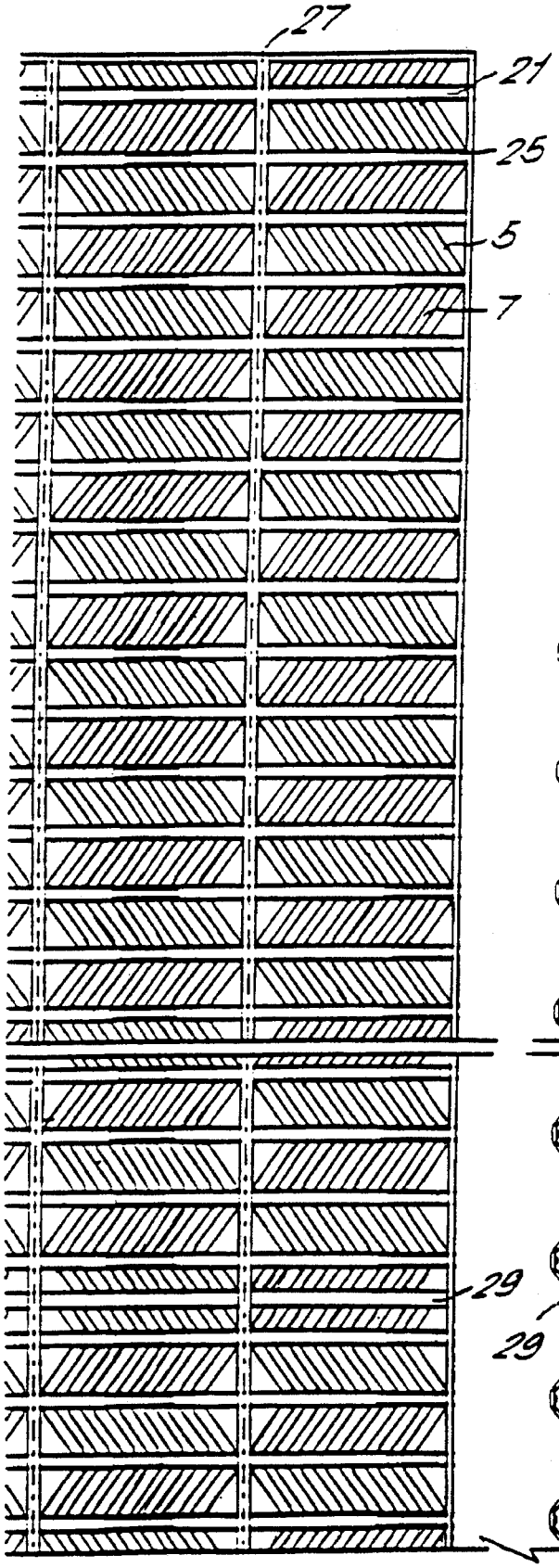
FIG. 6 shows an elevation view of a packing element including a join parallel to the corrugation direction in accordance with a preferred embodiment.

FIG. 6 shows an elevation of part of a packing element, and exemplifies a land 29 running parallel to the length of the sheet, made to extend the sheet width. In a preferred form of manufacture the sheets will be formed in sections from one land to another but will be separated from the formed pvc only at every alternate land, thus leaving half-lands 31 and 33 at each edge of the sheet and a full land in the middle. The land occurs between a peak and trough of corrugations at a distance from the edge of the sheen of typically 1.18 m. This method ensures that gluing or welding points of adjacent sheets do not occur on the edge of the sheets and thus provides a stronger joint and is to be preferred.

Figure 7:
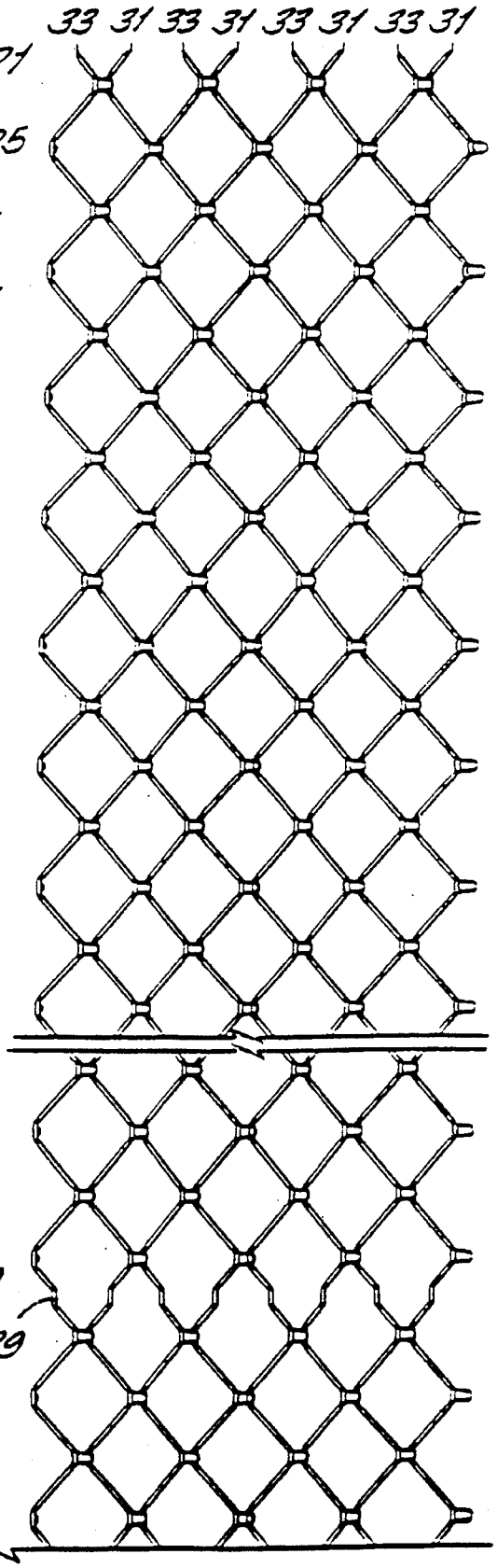
FIG. 7 shows a cross-sectional view of an assembled pack comprising sheet elements of the preferred embodiment shown in FIG. 6.

To facilitate assembling the sheets to form a pack as shown in FIG. 7, it is preferable to cut the sheets so that the edges of the sheets parallel to the corrugation direction are formed between a peak and trough with opposed edges 31 and 33 in FIG. 3 neighbouring a trough and a peak respectively. This is so that when every other sheet of an identical set of sheets is rotated 180°the edges of adjacent sheets are aligned and form a strong pack face perpendicular to the general plane of the sheets.

A particularly advantageous property of the above described embodiment is that of low air flow impedance. This is due to several factors including the linear nature of the passageways formed by the corrugations and the substantial invariance of their cross-sectional geometry. However, an especially significant factor is the relatively high free space to pack volume ratio which can be achieved as appreciated from FIG. 7. This is made possible by imparting appropriate structure to the pack to increase its rigidity and strength per unit area in directions both transverse and parallel to the corrugation direction, without requiring extra material. In this particular embodiment, the structure includes groups of oblique protrusions formed along the corrugations and groove formations formed tranverse of the corrugations. A pack requiring less material per unit volume has the additional advantages of reduced weight and reduced cost.

Although embodiments of the present invention have been described with reference to counterflow cooling towers, these or similar embodiments may also be used in cross-flow cooling towers. In this application, the pack is preferably orientated such that the corrugations run parallel to the cross-flow of air, i.e. horizontally, so that the pack presents least possible impedance to the air flow. With the corrugations disposed horizontally, in a preferred embodiment, the ridge formations will form a vertically running zig-zag pattern defining oblique deflection channels which change direction every half wavelength of the corrugations. In use, liquid descending a packing element will propagate in a meander-like path, changing direction every half wavelength of corrugation. This liquid distribution process is very similar to that when the pack is used in a counterflow cooling tower i.e., the corrugations are aligned vertically. It will therefore be appreciated that many of the advantageous properties of this pack when used in counterflow cooling towers, are carried over when the pack is used in crossflow cooling towers. This considerably enhances the versatility of the pack. In the special application where the pack is used as a hybrid pack, in which some of the packing elements remain dry, the pack may be modified to prevent liquid wetting these elements. As mentioned above the amplitude and wavelength of the corrugations as well as the dimensions and density of the ridge formations, may be varied depending on the application and position of a pack within the cooling tower. This may just be a matter of scaling a particular embodiment up or down. For example, it may be desirable to use packs having a larger surface area next to the liquid distribution apparatus. This may be achieved simply by scaling the pack down to increase the corrugation density. The scaling process will, however, also increase the density of the ridge formations. If this is undesirable, the ridge formation density may be changed independently of the corrugation density.

What is claimed is:

1. A film flow packing element for use in a cooling tower comprising a formable sheet material formed with corrugations and ridge formations extending obliquely of a direction parallel to a line along a peak of the corrugations to provide deflection channels for fluid descending over the packing element, the ridge formations being divided into a plurality of groups along said direction with the ridge formations of successive groups being angled oppositely relative to said direction, wherein the ridge formations extend over less than a pitch of the corrugations between a peak and a neighboring trough thereof.

2. A film flow packing element as claimed in claim 1, comprising an even number of groups over the dimension of the packing element along said direction.

3. A film flow packing element as claimed in claim 1, wherein each group has the same number of ridge formations.

4. A film flow packing element as claimed in claim 1, comprising at least four groups.

5. A film flow packing element as claimed in claim 1, wherein the ridge formations are formed to provide a zig-zag pattern transverse to said direction.

6. A film flow packing element as claimed in claim 5, wherein the pitch of the zig-zag pattern is equal to a whole number times the pitch of the corrugations.

7. A film flow packing element as claimed in claim 6, wherein the whole number is one.

8. A film flow packing element as claimed in claim 1, wherein the ridge formations comprise discrete linear protrusions in said sheet material.

9. A film flow packing element as claimed in claim 1, wherein the corrugations have a generally triangular wave form.

10. A film flow packing element as claimed in claim 1, wherein the peaks and troughs of said wave form are clipped so as to form flat portions extending along said direction.

11. A film flow packing element as claimed in claim 1, including transverse groove formations perpendicular to said direction.

12. A film flow packing element as claimed in claim 11, wherein the groove formations as located between successive said groups of ridge formations.

13. A film flow packing element as claimed in claim 1, including discrete stand-off formations upstanding along ridge lines of the corrugations on one face of the sheet and discrete socket formations formed along other ridge lines of the corrugations on the other face on said sheet, and positioned so as to engage each other when alternate sheets are rotated substantially 180° in the plane of said sheets.

14. A film flow packing element as claimed in claim 13, having at least one stand-off formation disposed between successive said groups.

15. A film flow packing element as claimed in claim 13, including transverse groove formations extending perpendicular to said direction, wherein at least one stand-off formation is formed between successive groove formations.

16. A film flow packing element as claimed in claim 13, wherein said stand-off formations and said discrete socket formations are spaced alternately at successive ridge lines of the corrugations.

17. A film flow packing element as claimed in claim 1, wherein edges of the sheet parallel to said direction are formed between a peak and a trough of said corrugations wherein opposed edges neighbor a trough and a peak respectively.

18. A film-flow packing element as claimed in claim 7, wherein each peak or trough of the zig-zag coincides with a peak or trough of said corrugation.

19. A film flow packing element as claimed in claim 13, wherein said stand-off and socket formations are sized so that when the stand-off formations of one sheet engage the socket formations of an adjacent sheet, the ridge lines on which those socket and stand-off formations are formed are maintained in spaced relationship.

20. A film flow packing element for use in a cooling tower comprising a formable sheet material formed with corrugations and ridge formations extending obliquely of the direction parallel to a line along a peak of the corrugations to provide deflection channels for fluid descending over the packing element, the ridge formations being divided into a plurality of groups along said direction with the ridge formations of successive groups being angled oppositely relative to said direction, wherein the ridge formations are formed to provide a zig-zag pattern transverse to said direction with each peak or trough of the zig-zag substantially coinciding with a peak or trough of said corrugation.

21. A film flow packing element as claimed in claim 20, comprising an even number of groups over the dimension of the packing element along said direction.

22. A film flow packing element as claimed in claim 20, wherein each group has the same number of ridge formations.

23. A film flow packing element as claimed in claim 20, comprising at least four groups.

24. A film flow packing element as claimed in claim 20, wherein the ridge formations comprise discrete linear protrusions in said sheet material.

25. A film flow packing element as claimed in claim 20, wherein the corrugations have a generally triangular waveform.

26. A film flow packing element as claimed in claim 25, wherein the peaks and troughs of said waveform are clipped so as to form flat portions extending along said direction.

27. A film flow packing element for use in a cooling tower comprising a formable sheet material formed with corrugations and having discrete stand-off formations upstanding along ridge lines of the corrugations on one face of the sheet and discrete socket formations formed along other ridge lines of the corrugations on the other face of said sheet, and positioned so as to engage each other when alternate sheets are rotated substantially 180° in the plane of said sheets, said socket and stand-off formations being sized so that when the stand-off formations of one sheet engages the socket formations of an adjacent sheet, the ridge lines on which those socket and stand-off formations are formed are maintained in spaced relationship.

28. A film flow packing element for use in a cooling tower comprising a formable sheet material formed with corrugations and having discrete stand-off formations upstanding along ridge lines of the corrugations on one face of the sheet and discrete socket formations formed along other ridge lines of the corrugations on the other face of said sheet, and positioned so as to engage each other when alternate sheets are rotated substantially 180° in the plane of said sheets, wherein edges of the sheet parallel to said ridge lines are formed between a peak and a trough of said corrugations wherein opposed edges neighbor a trough and a peak respectively.

* * * * *

UNITED STATES PATENT AND TRADEMARK OFFICE

CERTIFICATE OF CORRECTION

PATENT NO. : 5,474,832

DATED : December 12, 1995

INVENTOR(S) : THOMAS H. MASSEY

It is certified that error appears in the above-indentified patent and that said Letters Patent is hereby corrected as shown below:

Col. 6, line 49, delete "Linear", and insert --linear--

Col. 7, line 38, insert --.--, after "respectively"

Col. 8, line 20, delete "sheen", insert --sheet--

Col. 8, line 23, delete "sheen", insert --sheet--

Col. 9, line 14, delete "sheen", insert --sheet--

Signed and Sealed this

Nineteenth Day of March, 1996

*Attest:*

Bruce Lehman

BRUCE LEHMAN

*Attesting Officer*

*Commissioner of Patents and Trademarks*